US005305899A

United States Patent [19]

Kaufhold

[11] Patent Number: 5,305,899

[45] Date of Patent: Apr. 26, 1994

[54] COUPLER FOLLOWER WITH ELASTOMERIC WEAR PAD FOR PREVENTING METAL TO METAL CONTACT BETWEEN THE FOLLOWER AND THE CENTER SILL SIDE WALLS

[75] Inventor: Horst T. Kaufhold, Aurora, Ill.

[73] Assignee: AMSTED Industries Incorporated, Chicago, Ill.

[21] Appl. No.: 83,048

[22] Filed: Jun. 25, 1993

[51] Int. Cl.[5] ..... B61G 7/10

[52] U.S. Cl. ..... 213/50; 213/61; 213/75 R

[58] Field of Search ..... 213/10, 50, 51, 61, 213/62 R, 62 A, 75 R, 1 R; 105/225

[56] References Cited

U.S. PATENT DOCUMENTS

| | | | |
|---|---|---|---|
| 1,947,936 | 2/1934 | Glascodine | 213/50 |
| 4,203,371 | 5/1980 | Tack | 105/225 |
| 4,343,407 | 8/1982 | Murphy | 213/62 R X |
| 4,428,303 | 1/1984 | Tack | 105/225 |
| 4,444,609 | 4/1984 | Mathieu | 105/225 X |
| 4,573,594 | 3/1986 | Kunst et al. | 213/62 R X |
| 5,174,457 | 12/1992 | Caroll et al. | 213/61 |
| 5,176,268 | 1/1993 | Manley | 213/56 |

FOREIGN PATENT DOCUMENTS

| | | | |
|---|---|---|---|
| 2017611 | 10/1979 | United Kingdom | 213/62 R |
| 2017612 | 10/1979 | United Kingdom | 213/61 |

*Primary Examiner*—Douglas C. Butler
*Assistant Examiner*—S. Joseph Morano
*Attorney, Agent, or Firm*—Edward J. Brosius; F. S. Gregorczyk; Thomas J. Schab

[57] ABSTRACT

The present invention involves the addition of a device attached to each of the follower block side walls in order to prevent metal-to-metal contact between the follower block side walls and the center sill side walls. The preventative device comprises an elastomeric wear pad attached to a base plate, a base plate being anchored to each of the follower block side walls. The pads are made of a softer, low-friction material, compared to the carbon steel side walls. Since the elastomeric wear pads are softer than the center sill side walls, only the restrictive means will wear, thereby preventing destruction of the center sill side walls no matter how much slack has been developed in the coupling system. The present invention is also adaptable to either E or F type couplers.

4 Claims, 5 Drawing Sheets

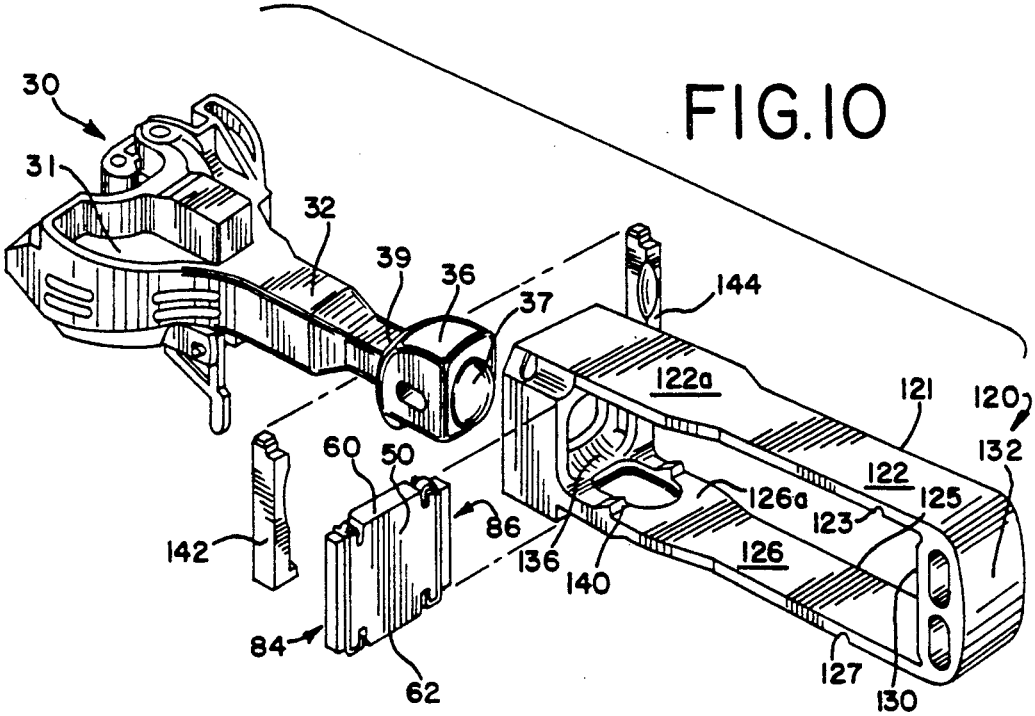
FIG.10
FIG.9
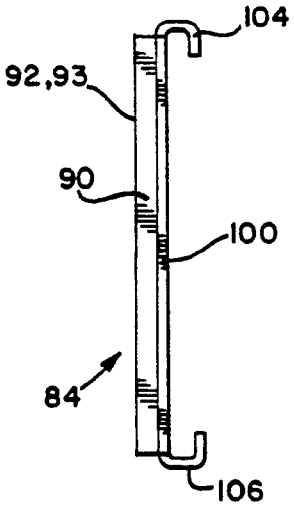
FIG.8
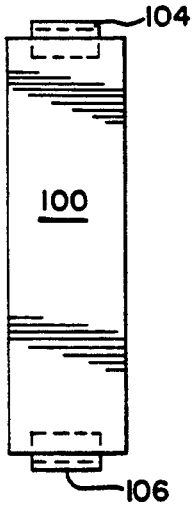

COUPLER FOLLOWER WITH ELASTOMERIC WEAR PAD FOR PREVENTING METAL TO METAL CONTACT BETWEEN THE FOLLOWER AND THE CENTER SILL SIDE WALLS

FIELD OF THE INVENTION

This invention relates generally to the art of railcar coupler systems, particularly to rotary and non-rotary systems. Coupler systems typically consist of a coupler, a yoke casting, a follower block and a draft gear assembly inserted within a railcar center sill structure. Specifically, this invention is directed to an improved follower block which prevents metal-to-metal contact between the follower block and the center sill sidewalls, thereby eliminating the destruction of the center side walls which normally occurs when the follower block contacts and abrasively wears the center sill side walls.

BACKGROUND OF THE INVENTION

In the development of modern passenger and freight railcar equipment, it has been found desirable to reduce free slack which develops from wear on the car's coupling system components that are mounted within the car center sill. Reduction of wear and the resulting slack on these components, particularly on the follower block, will either eliminate or greatly reduce costly sill side wall repairs.

Coupler assemblies are well known in the art and are independent units mounted on each adjacent railcar end for interconnection with one another to form a connection. They are located on the car undercarriage and are attached within the car's center sill structure. Besides holding the cars together, the coupler assemblies function to transmit generally longitudinally-directed forces to the car understructure.

In any car using a center sill, a cast yoke member is retained within the center sill cavity and it plays an important part in transferring the forces from the coupler head into the car understructure. Yoke castings typically include an upper and lower yoke strap member connected to a front and rear yoke wall, in order to form a longitudinal pocket. Yoke castings are well known in the industry and have been standardized dimensionally by the American Association of Railroads (AAR). Also standardized by the AAR are the couplers which are partially mounted within the yoke casting pocket. Typically, the coupler portion of a coupler system is a cast member consisting of an elongate shank portion. A head portion is formed at one end of the shank and a butt end portion is formed at the other end. Typically, the coupler portion can either be a fixed or rotary system, with the butt end portions of each system varying slightly in shape and method of attachment to the yoke casting. In a fixed system, the butt end is typically pinned to the yoke, while in the rotary system, the butt end is typically held inside the yoke by specially shaped retention keys.

It is also another standard of the AAR that a follower block be retained within the yoke casting pocket between the top and bottom yoke straps, internally of the coupler rear butt end portion. The follower block serves as a large bearing surface for communicating the large forces experienced by the coupler head into other coupling system members for final communication into the car understructure. The follower block is generally a solid member having a rectangular shape and the front face of the follower is held against the butt end of the coupler by a draft gear arrangement biasing the rear side of the follower block. The draft gear is typically a frictional energy absorbing and dissipating member which protects the car understructure from the impact forces imparted longitudinally on the coupler. The follower block and draft gear assembly are designed to coaxially and longitudinally move in unison with each other within the yoke casting pocket each time the coupler experiences an external force. In this manner, in response to draft (pulling), and buff (pushing) forces, particularly buff forces, the forces exerted against the coupler are transmitted through the butt end portion directly into the follower block where they are then transmitted into the draft gear and thereby cushioned. The forces absorbed by the draft gear are likewise transmitted into a pair of stationary rear center sill stops. Draft forces are transmitted essentially the same way, except that the follower block functions to transfer the forces pulling on the yoke casting into the center sill side walls through contact with a pair of stationary front center sill stops. The draft assembly now functions to keep the follower biased in place against the butt end portion of the coupler.

The lateral forces experienced by the coupler are not as severe as the longitudinal forces and they are transferred into the center sill in a much different fashion. Since lateral forces tend to push the coupler head in a lateral direction with respect to the longitudinal centerline of the car, the butt end of the coupler also moves, but in the opposite, lateral direction relative to the coupler head. This also means that when the coupler head end is laterally moved, the follower block also moves laterally in unison with the butt end, since the follower block is held against the butt end by the biasing means of the draft gear.

One of the problems with known follower blocks is that the AAR approved follower is designed to have large tolerances between the side walls of the block and the center sill side walls. More particularly, the follower is free to laterally travel within the center sill cavity until it makes contact with the center sill side walls. When a coupler system is new and initially installed within the car understructure, the clearances between the aforementioned system components, known in the art as controlled slack, are minimal. This is true even when the forces on the coupler are reversed, such as when the car is accelerated or decelerated. Eventually however, the extreme forces experienced by the car will cause wear to occur in the entire coupling system such that small gaps will begin to appear between each of the coupler system components. These gaps are known in the art as free slack, and the cumulative affect of the free and controlled slack is to magnify all impact forces experienced during the acceleration and deceleration of the car. It has been known that the lack of confinement of the follower block within the center sill cavity has proved inadequate because the slack between the center sill side walls and the follower block will cumulatively accelerate the wear between the center side walls and the follower block. The end result is that the harder, cast steel follower block eventually wears the softer, steel center sill side walls. If this condition is not detected, the follower block can wear the center sill side walls thin enough so that the car center sill structure will be weakened in the immediate contact area such that the follower block can wear completely through the center sill side walls. If this happens, the coupling system will no longer function as designed. Ultimately, the railcar will have to be removed from service in order to patch and weld the center sill. This method of repair is both time consuming and very expensive because the car must be removed from service and disassembled. Furthermore, the integrity of the railcar center sill is diminished.

A review of certain known patents also shows that little effort has been made to address the center sill wear problems caused by the lateral follower block movement.

U.S. Pat. No. 1,947,936 to Glascodine discloses an outdated coupling system wherein metal liner plates were mounted against the center sill side walls, with a resilient rubber insert being held between the liner and the center sill walls. The rubber insert was to be protected by the liner plates and was intended to absorb the lateral stresses imparted to the side walls by a front and rear follower block. Each follower block side wall peripherally extended into metal-to-metal engagement with the liner plates such that abrasive metal-to-metal contact was not eliminated, leaving the system vulnerable for destructive metal wearing.

U.S. Pat. No. 5,176,268 to Manley is the only known art to address the lateral movement problem as presented in more modern and AAR-approved coupling assemblies recommended today. In that disclosure, Manley addresses the above-mentioned problems by providing an improved follower block which confines the position of the yoke casting within the center sill. The purpose of this follower is to prevent movement of the coupling system components so that free slack does not develop and eventually cause destruction of the center sill side walls. The follower disclosed in the Manley patent is constructed such that it is wider than the AAR standardized follower, making it essentially span the width of the center sill cavity with much less initial controlled slack than before. Furthermore, the rectangularly shaped follower is provided with an outwardly extending tab at each corner of the follower block. The tabs extend upwardly and downwardly, respectively, from the top and bottom sides of the follower, and each of the tabs are lined with an elastomeric wear insert. The respective top and bottom yoke strap is tightly confined between the respective top and bottom pairs of tabs so that in spite of the application of stresses which normally cause lateral follower and yoke movement, the follower maintains the confined configuration of the follower-yoke-side wall interface. However, such efforts to confine the yoke are not the most effective because of the extreme forces placed upon the relatively small bearing surface area of the tabs. Since free slack eventually develops in all coupling components, the tab wear inserts experience extreme and concentrated stress loading, thereby being prone to wear in a relatively short time period and generating additional free slack. Once the additional free slack is introduced in this arrangement, the wear inserts deteriorate at a cumulatively faster rate and the center sill side walls will eventually experience substantial metal-to-metal frictional contact with the side walls of the follower block since this design does not eliminate the potential for metal-to-metal contact between the follower block and center sill side walls. Once again, the problem of a metal follower block potentially wearing the metal center sill side walls is present.

BRIEF SUMMARY OF THE INVENTION

Accordingly, it is an object of the present invention to provide an improved railcar coupling follower block which distributes external lateral forces received by the coupler butt end, directly into the center sill side walls.

It is another object of the present invention not to allow any portion of the follower block to contact the yoke upper or lower strap side walls, thereby ensuring unrestricted movement of the follower block in the center sill cavity and a longer wear life for the follower block and yoke.

Briefly stated, the present invention involves adding preventative means to each of the follower block side walls so that elastomeric wear pads on each of the preventative means will contact the center sill side walls during normal operative use and not allow the follower block to directly contact the center sill side walls. By placing the preventative means on the follower block side walls, destructive wear of the center sill side walls, which normally is caused by metal-to-metal contact between the follower block side walls and center sill side walls, is eliminated even when the coupling system components develop substantial free slack from extended use and wear. Furthermore, the potential for abrasive metal-to-metal contact between these two components is also eliminated since the preventative means is interposed between the follower block and the side walls.

BRIEF DESCRIPTION OF THE DRAWINGS

The following description of the invention will be better understood by reference to the accompanying drawings, wherein:

FIG. 8 is a front view of the preventative means base plate;

FIG. 9 is a side view of preventative means fully assembled with the elastomeric wear pad attached to the base plate;

FIG. 10 is an exploded view of an F-type rotary coupler system utilizing the follower block of the present invention;

DETAILED DESCRIPTION OF THE PREFERRED EMBODIMENT

Figure 1:
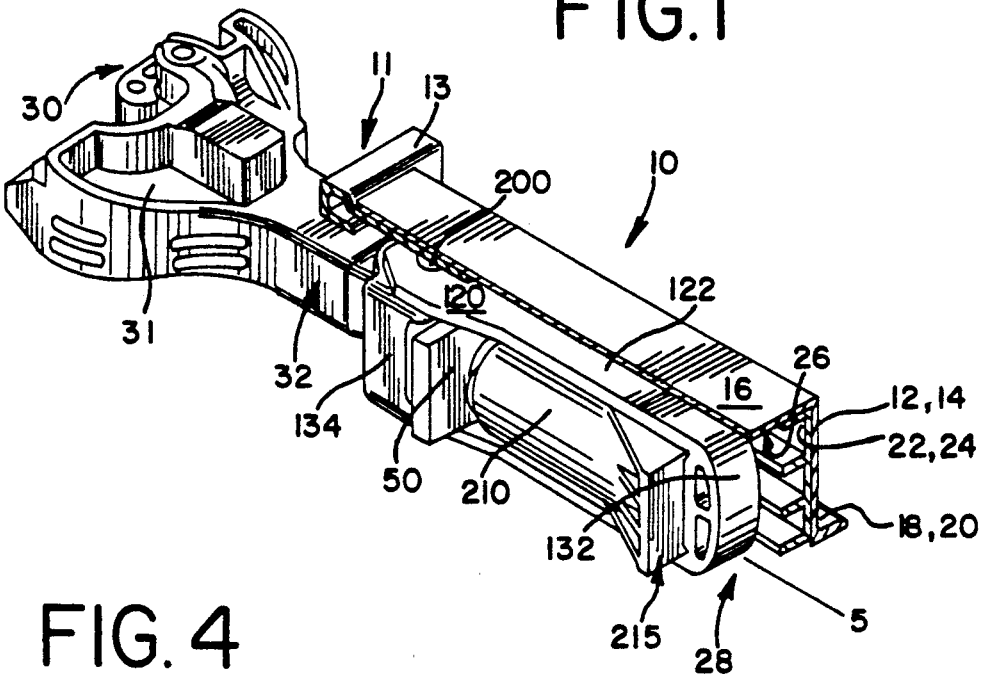
FIG. 1 is a perspective view of a fixed end coupling system comprised of a F-type coupler, a follower block, a draft gear, and a yoke casting contained within a center sill, a portion of the center sill removed for clarity.

Turning now to FIG. 1 of the drawings, a fixed end coupling system will now be described. A railcar coupling system is the force absorbing mechanism on a railcar which also joins the cars together, and it typically consists of a coupler 30, a yoke 120, a draft gear 210, and a follower block 50, inserted into an inverted U-shaped channel member referred to as the center sill 10. Center sill 10 is longitudinally mounted underneath the bottom of the railcar and is generally in alignment with the centered, longitudinal axis 5 of the car. Center sill 10 is comprised of side walls 12 and 14 which are connected to top wall 16, and each side wall 12, 14 terminates with side flanges 18 and 20. Side walls 12 and 14, and top wall 16 also have respective inside surfaces 22, 24 and 26, and the three walls define center sill cavity 28. Cavity 28 longitudinally extends along the length of the car and is in alignment with the centered and longitudinal axis 5 of the railcar. The center sill 10 also has an open center sill end 11 at each distal end of the center sill and railcar, although in FIG. 1, only one open end 11 of center sill 10 is shown.

Figure 2:
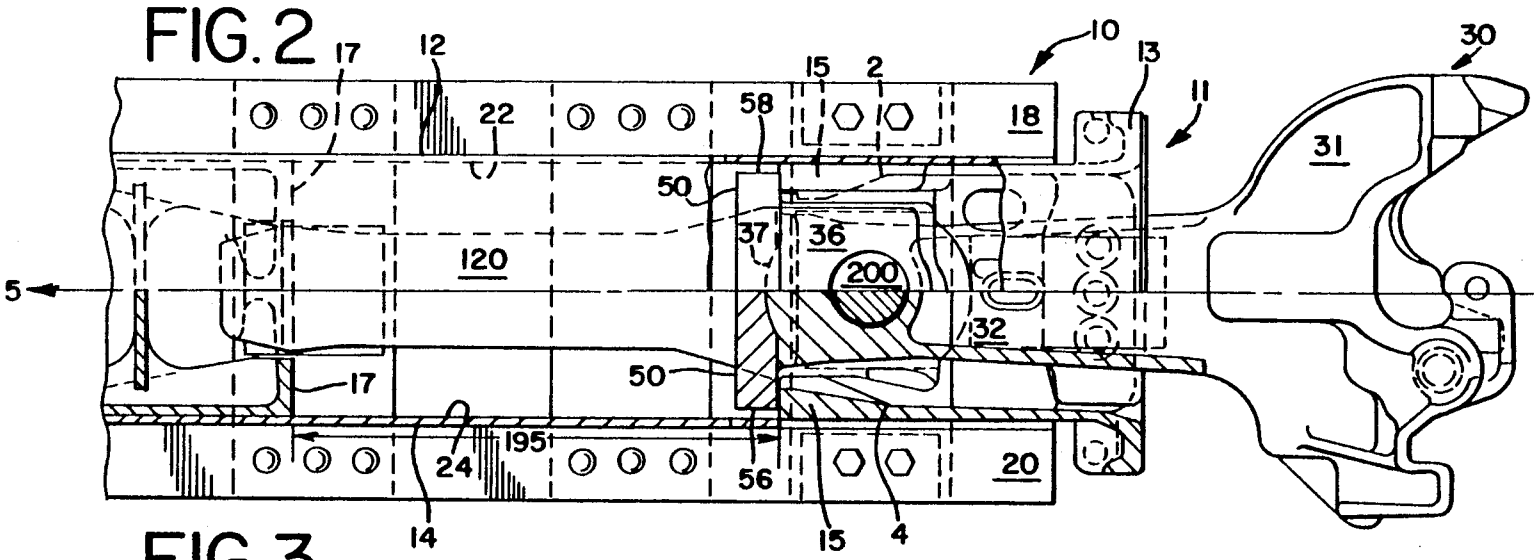
FIG. 2 is a plan view of the fixed coupling system shown in FIG. 1.
Figure 3:
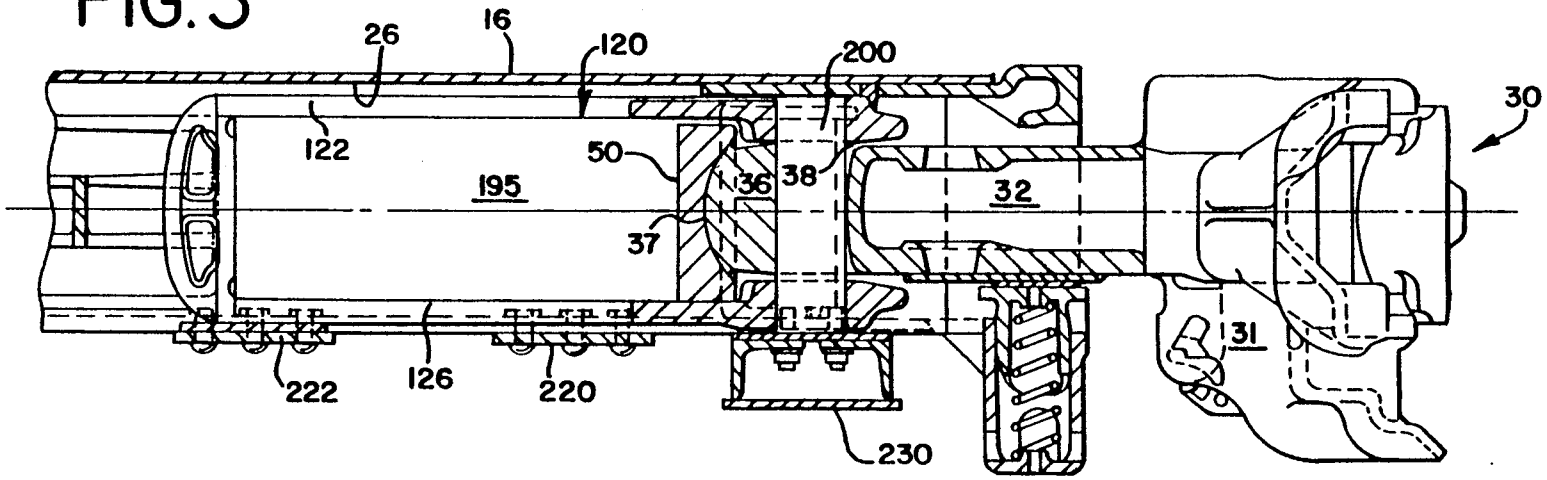
FIG. 3 is a side view of the fixed coupling system of FIG. 1.

Now referring to FIGS. 2 and 3, it is seen that a striker casting 13 is inserted into each of the open ends 11, and is then attached to center sill 10, usually by welding the striker to each of the center sill side wall inside surfaces 22 and 24. Integrally a part of striker casting 13, are the pair of opposed front stops 15, which are disposed longitudinally inward from open end 11. Similarly, a pair of cast, opposed rear stops 17 are attached to each of the center sill side wall inside surfaces 22 and 24, longitudinally inward from front stops 15 and open end 11. Front and rear stops 15 and 17 are used for transferring all external forces which are applied to coupler 30, into the center sill side walls 12,14, as will become apparent shortly.

Figure 4:
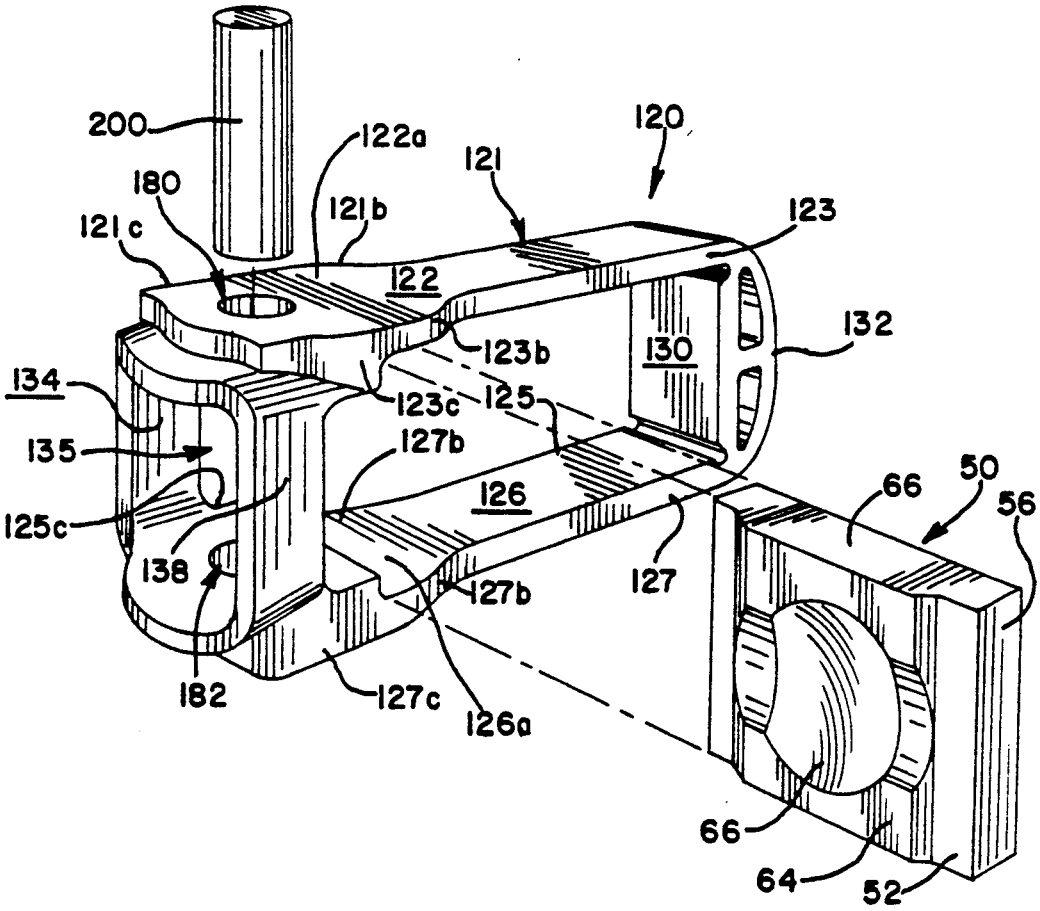
FIG. 4 is perspective view of the yoke casting, connecting pin, and follower block of a fixed coupler system.

As illustrated in FIGS. 1-3, at the heart of the coupling system is yoke member 120 and this structure is well known in the industry as those used in connection with fixed F-type couplers. Shown in greater detail in FIG. 4, the yoke 120 is formed by casting and includes an upper strap 122, a lower strap 126, an internal rear wall 130 and rear wall outside surface 132. Each of the upper and lower straps are generally rectangular in configuration and are mounted to extend longitudinally along axis 5 of the center sill. Upper yoke strap 122 being generally rectangular, has parallel side edges 121 and 123 which extend outwardly by means of the outwardly tapered or flared edges 121*b* and 123*b*, forming the enlarged portion 122*a* through straight side edge portions 121*c* and 123*c*. Similarly, lower yoke strap 126 includes straight side edges 125 and 127 which extend outwardly by means of the outwardly tapered edges 125*b* and 127*b*, through straight side edge portions 125*c* and 127*c*, forming lower strap enlarged portion 126*a*. Yoke 120 is disposed between center sill side walls 12,14 and within the center sill cavity 28 such that it is in close approximation, but not touching, center sill inside surfaces 22, 24 and 26. Yoke casting 120 is retained within center sill cavity 28 by supporting bottom strap 126 with front and back support plates 220 and 222, respectively, which are bolted to flange members 18 and 20, as best seen from FIG. 3. The upper strap 122 terminates at its outer end in an enlarged portion 122*a* having a centered throughbore 180 therein. Similarly, lower strap 126 terminates at its outer end in an enlarged portion 126*a* having a centered throughbore 182 in vertical alignment with throughbore 180, each receiving connecting pin 200. As will become more evident later, pin 200 connects the coupler 30 to yoke 120 in order to serve as a means for transferring the forces experienced by coupler head 31 into the yoke and center sill. Front side walls 134 and 138 are cast with the entire yoke member 120 as a unitary casting, thereby providing substantial support to the yoke casting as a whole.

The coupling system provided in FIG. 1 also includes a standard F-type fixed-end coupler 30 that includes a coupler head 31 which is adapted to engage a complementary coupler head on another rail car. FIGS. 2 and 3 show that coupler 30 is also formed with a generally rectangular and longitudinally extending shank 32 which terminates internally with butt end 36. Butt end 36 also has a generally rectangular shape, and it includes a projecting spherical surface 37 and vertical throughbore 38. The butt end 36 of coupler 30 is insertably received by the generally rectangular shape of yoke 120, which has open sides that define an internal area of the yoke called the draft gear pocket 195. Draft gear pocket 195 receives and houses butt end 36, the follower block 50, and the draft gear assembly 210. The front end of yoke 120 contains a rectangularly shaped passage 135, so that coupler butt end 36 can be inserted into and connected with yoke 120. The coupler and yoke are connected to each other by inserting connecting pin 200 into butt end throughbore 38 and yoke top and bottom throughbores 180 and 182. The connecting pin 200 is held in place by support channel 230 illustrated in FIG. 3, which is bolted to the bottom surfaces of flanges 18 and 20.

It is important to understand that the FIG. 1 coupling system just described pertains to a fixed end arrangement, where the coupler head and shank are stationary. In a rotary coupling system, shown in FIG. 10, the coupler head and shank are made so that they can rotate once held within yoke 120. The remaining components of the rotary coupling system are the same components used in the fixed coupling system, making the rotary system function similarly to the fixed system in terms of force absorbing performance. As seen in FIG. 10, top and bottom yoke straps 122,126, each have a pair of opposed stop tabs 140 for retaining follower block 50, although in this figure, the top stop tabs cannot be seen. Left and right locking keys 142,144, are used to lock the butt end 36 of the rotary coupler 30 in place inside yoke 120, in place of using the previously described connecting pin arrangement. In this way, coupler 30 and shank 32 are now free to rotate because, as seen in FIG. 10, shaft 32 is necked down and butt end 36 has a generally rounded configuration which is adaptable for rotation once coupler 30 is locked into place with keys 142,144. Locking keys 142,144 are retained within yoke 120 by similar support channel 230, which was used in the fixed coupling system.

Figure 6:
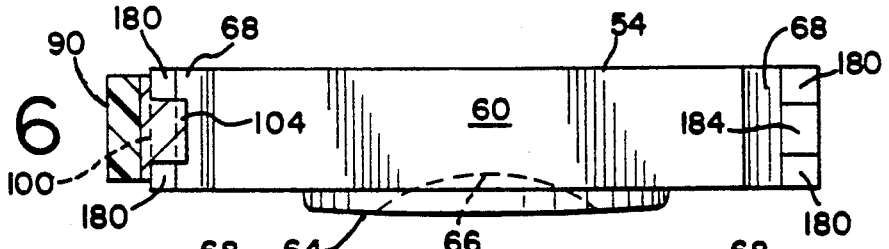
FIG. 6 is a top view of the embodiment shown in FIG. 5.
Figure 5:
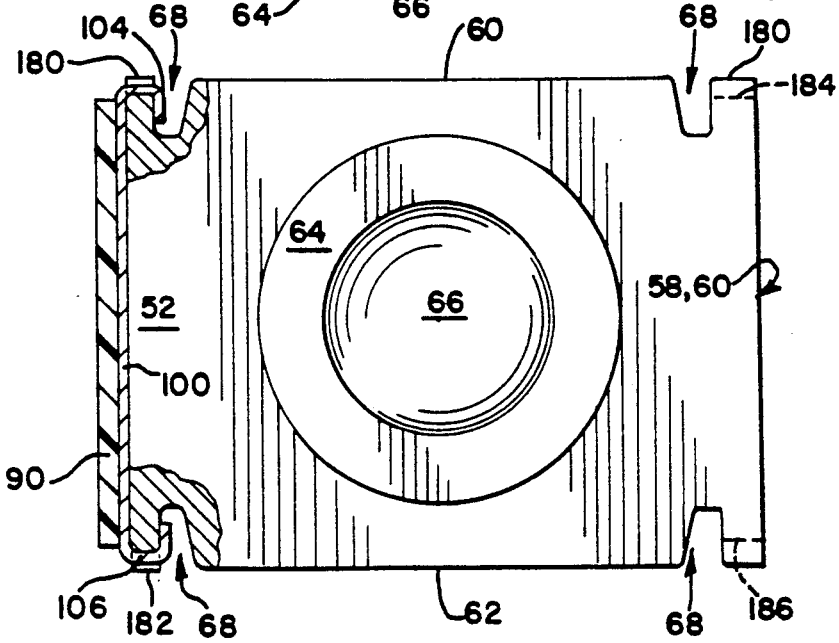
FIG. 5 is a front view of a rotary coupling system follower block of the present invention containing the preventative means for eliminating metal-to-metal contact between the follower block and center sill side walls.

In cooperative engagement with the coupler butt end 36 of either the fixed or rotatable coupler, is the generally rectangularly shaped follower block 50, which is disposed between butt end 36 and draft gear system 210. From FIG. 4, where a fixed coupler yoke 120 and a follower block 50 are shown, it is seen that the front follower face 52 of follower block 50 has a raised portion 64, out of which a smaller, spherically shaped recess 66 is provided. Spherical recess 66 is complementary to the spherically shaped projecting surface 37 of butt end 36. For the rotary system, follower block 50 is designed to match the characteristics of the butt end 36 of the rotary coupler 30. As illustrated in FIGS. 5 and 6, where a follower block for a rotary coupling system is shown, the follower block on the rotary coupling system has front face 52 which has a round raised portion 64 projecting outward. The round raised portion 64 also has a spherically shaped socket 66 cut into the surface and this socket is complementary to and receives the spherically shaped surface 37 projecting from butt end 36.

When either of the coupling systems are operably connected, spherically projecting surface 37 on butt end 36 and recess 66 on follower block 50 form a mated relationship which is similar to a ball-and-socket joint, the mated relationship resulting from the biasing element inside draft gear 210 (not shown), pushing follower 50 into contact with butt end 36. The follower block front and rear faces 52,54 are large load bearing surfaces for transmitting and evenly distributing the draft and buff load forces experienced by the coupler system into center sill side walls 12,14. During a state of no load, draft gear assembly 210 biases follower block front face 52 forward into simultaneous contact against front stops 15 and generally butt end 36, while an equal and opposite force pushes the draft gear wings 215 into constant contact with rear stops 17.

Buff loads are those which push coupler head 31 into the center sill 10. For the fixed coupling system, they are transferred from head 31, down the shank 32, and into the connecting pin 200. Pin 200 transmit the forces to the upper and lower yoke straps 122 and 126, which in turn, cause the yoke 120 to move backwards. With the rotary coupling system, they are transferred from head 31, down shank 32, and into butt end 36. Since butt end 36 is in contact with follower block 50, the forces continue through follower 50, into draft gear 210 and finally into draft gear wings 215 and rear stops 17. With either the fixed or rotary system, the buff forces are resisted by the internal biasing element of draft gear 210 pushing against follower block 50 with an equal and opposite force into rear stops 17. The forces acting against rear stops 17 are finally transferred into center sill side walls 12 and 14. It should be noted for the fixed system that when coupler 30 is thrust backwards by a buff load, the follower block front face 52 disengages from front stops 15 and moves backwards along longitudinal axis 5, towards rear stops 17, in unison with the movement of the yoke 120. The yoke casting 120 and follower block 50 only move backwards by the distance equal to the amount of compression in the draft gear biasing element. However, with the rotary system, once the follower block disengages from the front stops and begins to move backwards, the yoke 120 does not correspondingly move backwards since the keys 142,144 do not act as an interconnection between the yoke and coupler.

Draft loads are those which pull coupler butt end 36 towards open end 11 of center sill 10. Draft forces on the fixed coupling system are likewise transferred from the coupler, through the connecting pin 200, and eventually into top and bottom straps 122 and 126 and the yoke 120 is free to move towards open sill end 11 until follower 50 abuts front stops 15. From FIG. 10, it is seen that with the rotary system, once coupler 30 is acted upon, the spherically shaped surface 39 on butt end 36, abuts a complementary spherical surface 136 of yoke 120, thereby transferring the forces into the top and bottom yoke straps 122,126 for eventual distribution into the center sill side walls 12,14. With either the fixed or rotary systems, when coupler 30 is being acted upon, draft gear assembly 210 biases follower block 50 into contact generally with the butt end 36 of coupler shank 32 and with front stops 15. This means that when yoke 120 moves toward open center sill end 11, follower block 50 abuts front stops 15 and the draft forces are then directly transferred into the center sill side walls 12,14 via the front stops 15. During draft loading, the biasing element inside draft gear 210 extends outwardly towards open end 11, thereby maintaining a constant pushing force against the follower block back face 54, holding follower front face 52 against the front stops 15, while rear wings 215 disengage rear stops 17.

Laterally directed forces are those which are applied to the coupler 30 when the railcar encounters a turn or uneven track and they cause butt end 36 and follower block 50 to move in a direction opposite to the movement of coupler head 31. With a fixed coupler system, the laterally directed forces are transferred from the coupler 30, into pin 200, and then into top and bottom yoke straps 122 and 126. With the rotary coupler system, the laterally directed forces are transferred from the coupler 30, into spherical butt end surface 39, and then into spherical yoke surface 136, seen in FIG. 10. With either the fixed or rotary system, once the forces are transferred into yoke 120, the yoke moves laterally towards either striker casting side wall 2 or 4, which is best seen from FIG. 2. Since striker casting 13 is welded to each of the center sill side wall inside surfaces 22,24, any lateral forces experienced by the coupling system will be transmitted through the yoke and into the center sill 10. When the yoke laterally moves, follower block 50 also moves in the same direction as the yoke 120. The follower movement is the result of butt end 36 pushing either of the follower block side walls 56 or 58 into contact with a corresponding center sill side wall, thereby transferring part of the laterally directed forces directly into the center sill side walls.

In a new coupling system, whether it be a fixed or rotary system, follower block side walls 56,58 are designed to slightly contact the center sill side walls when lateral forces act on the coupler head 31. However, if follower block side walls 56,58 develop enough free slack during the course of normal wear on the coupling system, substantial lateral movement of the follower block will occur. As previously explained for either system, when butt end 36 laterally displaces, one of follower block side walls 56 or 58 will contact one of center sill side wall inside surfaces 22 or 24 since follower block 50 and butt end 36 are in constant, intimate contact with each other. The controlled slack which was purposefully provided between follower 50 and inside wall surfaces 22 and 24 for installation purposes, will eventually develop additional free slack when side walls 58,60 repeatedly abrade center sill inside wall surfaces 22,24 each time the coupling system experiences lateral forces. Moreover, since center sill 10 is made from construction grade steel, the surfaces 22 and 24 will wear at an accelerated rate compared to the much harder, cast steel follower block 50. After each occurrence of abrasion, the wear will accumulatively accelerate and cause a faster deterioration of side walls 12,14, as compared to the other coupling members. Depending upon the scheduled maintenance and inspection program for each particular railcar, it is possible for follower block 50 to wear through either side wall 12 or 14. This damage caused to the center side walls does not allow the coupling system to function as designed, and it is also very costly to repair.

Figure 7:
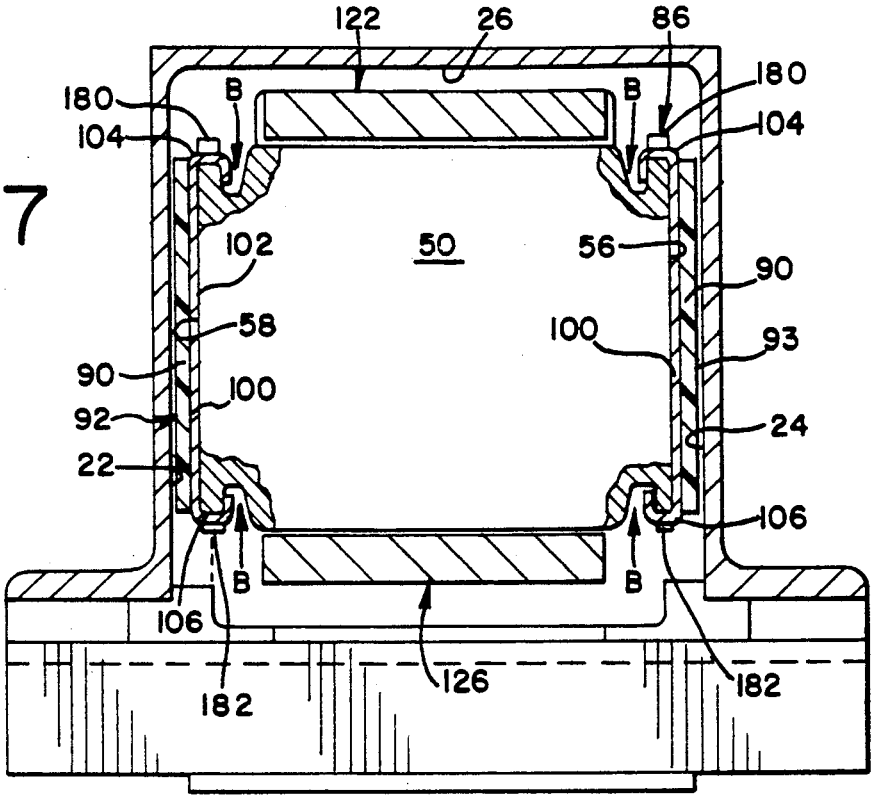
FIG. 7 is a front cross sectional view showing assembly of the center sill, yoke and the follower block of the present invention.

The follower block of the present invention is illustrated in FIG. 7, and it is important to understand that the general features and operation of this follower block design can be applied to either the fixed coupling system follower block or the rotary coupling system follower. In either case, the follower block will be equipped with a pair of opposed center sill wear preventative means 84,86 on each of the follower block side walls 56,58 for eliminating metal-to-metal contact between the follower block and the center sill side walls. The preventative means 84,86 extend laterally outward from each of the follower block side walls 56,58 such that they are always located outwardly of yoke 120 and transverse to the longitudinal axis 5, maintaining proximity with inside wall surfaces 22,24. Even though an E-type coupler system has not been shown in any of the illustrations, it should be understood that the present invention can also be used with a E-type coupler too. The present invention will be described in greater detail with respect to the rotary coupling system shown in FIG. 10. Therefore, it should be realized that the follower block which will be described in detail and which is seen in FIGS. 5–7, is for the rotary system, although the features of the present invention are equally applicable to the follower block of the fixed coupling system which is illustrated in FIG. 1.

The preventative means 84,86 attached to follower block 50 are mirror images of each other, so only one of them will be described in greater detail. As seen from the detailed views in FIGS. 8 and 9, means 84 consists of two elements; a replaceable plate 100, and a replaceable elastomeric wear pad 90, attached to plate 100. Plates 100 are typically formed by stamping them from a common piece of steel flat stock, although they can be made in any other fashion. The base 102 of plate 100 is substantially the same size as pad 90 and wear pads 90 are of a thickness which will project them from follower block side walls 56,58, outwardly across center sill cavity 28, into immediate proximity with center sill side wall inside surfaces 22,24. Pads 90 are initially provided so that there is typically about 0.125 inches (3.175 mm) of controlled slack(tolerance) between pad 90 and each of the inside surfaces 22,24. It would be ideal to have even less controlled slack, but due to casting variances, this distance has been found to be the best so that when slightly larger follower blocks or slightly smaller center sill openings are encountered, the follower can still be installed. As seen, from FIGS. 5 and 6, follower block 50 is cast with special top and bottom wall anchoring channels 68, which are located near each of the four corners of the rectangular follower block 50. Each channel extends across the width of follower block 50 and is generally parallel to, and outside of each the respective yoke strap top and bottom side walls 121,123, and 125,127, when it is installed inside of yoke casting cavity 195. Each channel is substantially of the same depth and is located inboard substantially the same distance from their respective side wall 56 or 58. In the embodiment shown in FIGS. 5–7, top and bottom flange areas 180 and 182, respectively, are cast such that they extend upwardly or downwardly, respectively, to the same height as the respective follower block top and bottom walls. From FIG. 6, it should be understood that each respective flange 180,182, has a central slot 184,186, respectively, for receiving the appropriate legs 104,106 on the preventative means 84,86. As illustrated in FIG. 5, base 102 is of the same vertical dimension as that corresponding to the distance between top and bottom slots 184,186, herein marked "A". However, FIG. 10 illustrates that it is preferable that plate 100, and for that matter, preventative means 84, does not cover the entire width of follower block side walls 56 or 58. The reason is that if pad 90 were allowed to contact front stops 15 when follower 50 does, the pads would experience longitudinally directed shear forces and under the extreme loading conditions of a railway system, the shear forces could cause shearing of pad 90.

Elastomeric pad 90 is attached to plate 100 preferably by bonding, although any commonly used methods of attachment such as bolting, gluing, or snap-fit means can be used. Elastomeric pad 90 is preferably made of a low coefficient of friction material such as Nylatron NS and as mentioned, is substantially the same size as that of the base 102 of plate 100, as seen in FIG. 9.

Means 84,86 are attached to each respective side wall 56,58 by first inserting top leg 104 and then bottom leg 106 into respective top and bottom channel 68. The width of legs 104 and 106 are such that each leg can be snugly inserted and maintained within each respective slot 184,186. The upper and lower legs 104,106 can then be tack welded to follower 50 by placing the welding bead as shown in FIG. 7 along area "B" for added security. As illustrated in FIG. 9, top leg 104 and bottom leg 106 are bent backwards at a 90 degree angle before insertion and tack welding of each leg to their respective channel 68. It is preferable that top and bottom legs 104,106 substantially lie in the same horizontal plane as follower block top and bottom walls 60,62 so that the two surfaces are flat with respect to each other, although they are shown for the sake of clarity in the figures as being slightly lower than top and bottom walls 60,62. It is acceptable if the legs 104,106 are lower than top and bottom surfaces 60,62, however, a non-acceptable situation would leave legs 104,106 extending above top and bottom walls 60,62.

Figure 11:
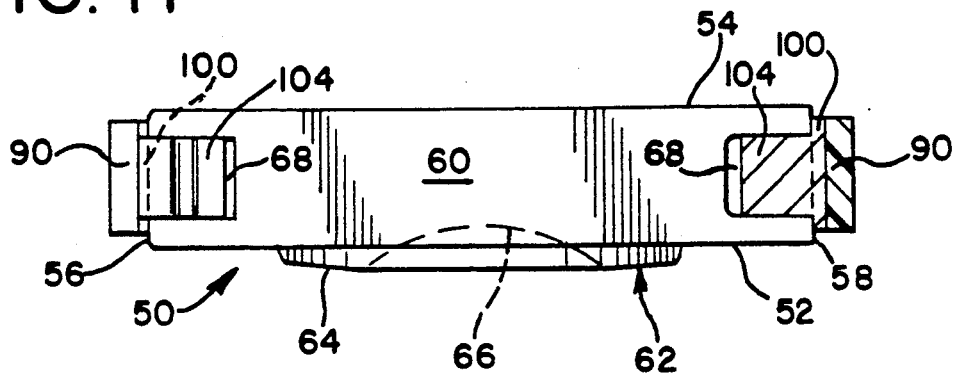
FIG. 11 shows a top view of a second embodiment of the rotary system follower block of the present invention.
Figure 12:
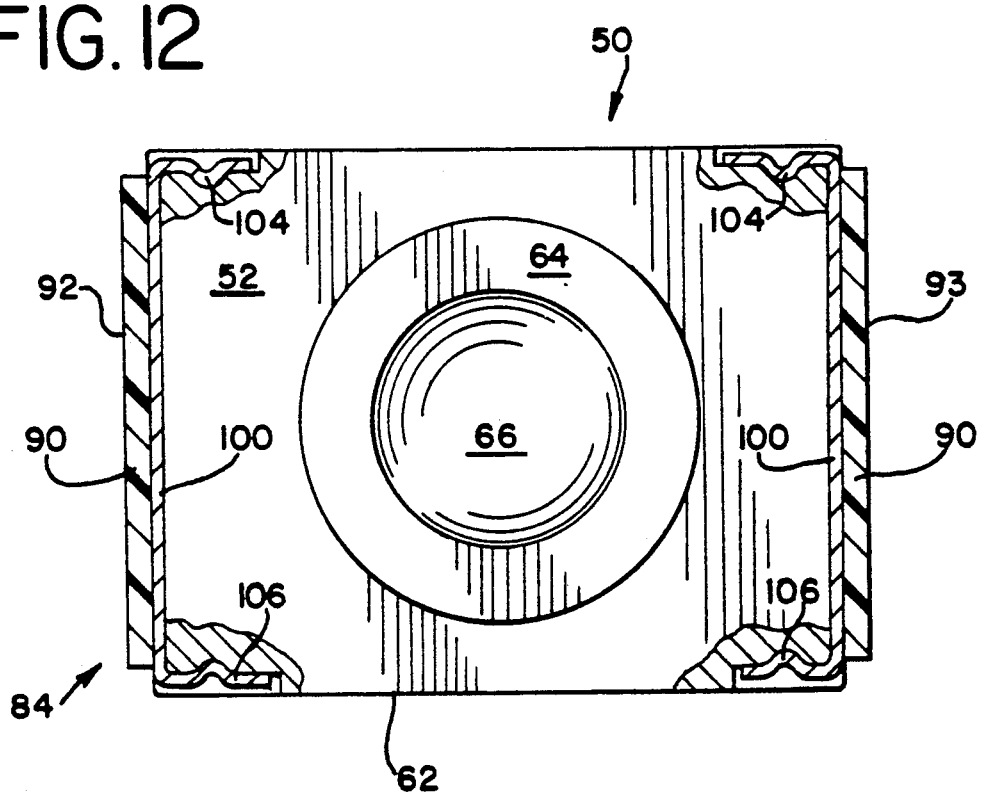
FIG. 12 is a front view of the embodiment shown in FIG. 11.

In a second embodiment, shown in FIGS. 11 and 12, it can be seen that restrictive means 84 is again attached to each of the side walls 56,58, with only the method of attachment differing. It is seen that each corner of the follower block again contains channels 68 across the width of follower 50, and the channel is not as deep as in the previous embodiment. However, the legs 104,106 extend beyond the channel instead of hooking into it since slots 184,186 extend beyond channels 68 a short distance. Each leg is attached by using a hammer and a chisel or punch to literally pound each of the legs 104,106 on each of the restrictive means 84,86 into each of the channels 68. It is preferable that either a portion or the entire edge of each of the legs 104,106 be tack welded along the perimeter of slots 184,186. Like the previous embodiment, it is preferable that the top surface of each of the legs 104,106 lie substantially in the same plane as its respective top or bottom wall 58,60.

In operation and use, follower block 50 is placed in position inside center sill 10 and specifically within draft gear pocket 195 by engaging front face 52 against butt end 36 of coupler 30. Referring again to FIG. 7, the preventative means 84,86, project outwardly from respective follower block sides 56,58, such that pad outside surfaces 92 and 93 are immediately adjacent to center sill inside surfaces 22 and 24. Each of the peripherally extending pads 90 fictionally engages it's respective inside surface 22 or 24 in response to laterally directed forces applied to coupler head 31. Top and bottom walls 60,62 of follower 50 are free to slide laterally across draft gear pocket 195 such that they loosely contact respective top or bottom yoke strap 122 or 126 without interfering with yoke 120. The large surface area of each of the elastomeric pads 90 provides a much larger, and less concentrated load bearing area when compared to prior art designs, providing a better distribution of forces into the center sill side walls 12 and 14 without the abrasive destruction which occurs in prior art followers after free slack begins to develop. Pads 90, being made of a low coefficient of friction material, easily slide if any shear forces act upon the follower. One important aspect of the present invention is that no matter how much wear of the pad occurs, there will never be metal-to-metal contact present between the follower and the center sill. This means that even when they have to be replaced during servicing, there will be no occurrence of side wall destruction. Furthermore, the present invention never makes metal-to-metal contact against either of the top or bottom yoke strap side walls either.

The foregoing description has been provided to clearly define and completely describe the present invention. Various modifications to the method of mounting the wear pads to the follower block side walls or even to the center sill inside wall surfaces may be made. However, those types of modifications do not depart from the scope and spirit of the invention, which described in the following claims.

What is claimed is:

1. A railroad car coupling system extending into a car center sill structure for connecting adjacent railcar ends, said center sill structure having a longitudinal axis and a first side wall with a flange, a second side wall with a flange and a top wall, each of said walls connected together to form an inverted, generally U-shaped center sill structure that defines a cavity corresponding with said longitudinal axis of said center sill, said coupling system comprising:

a yoke retained within said center sill cavity, said yoke having a longitudinal axis in alignment with said center sill longitudinal axis and including a top strap and a bottom strap which extend longitudinally and parallel to each other, said straps connected to an internal rear wall to form a yoke pocket;

a coupler member, said coupler member having a shank with a first end and a second end, a coupler head, and a generally rectangularly shaped butt end, said coupler head attached to one of said first or second shank ends, and said butt end attached to the other of said first or second shank ends, said coupler butt end extending longitudinally into said yoke pocket;

a draft gear within said yoke pocket and in abutment with said yoke internal rear wall, said draft gear receiving and dissipating external forces experienced by said coupler member, which said forces are transferred from said coupler head to said butt end;

a follower block retained within said yoke pocket for receiving said forces experienced by said coupler member, said follower block positioned transversely to said yoke longitudinal axis, said follower block having a generally rectangular shape defined by a top wall, a bottom wall, a first side wall, a second side wall, a front face and a rear face, said front face in contact with said coupler member butt end and said rear face in contact with said draft gear biasing element, said follower block transversely travelling within said enter sill pocket while guided between said top and bottom yoke straps; and means for preventing said follower block from directly contacting said center sill side walls, said means attached to each of said follower block sidewalls and extending outwardly of said yoke pocket for eliminating abrasive metal-to-metal contact between said follower block side walls and said center sill side walls, said means also protecting said follower block side walls from metal-to-metal contact, whereby wear of said center sill and follower block side walls is eliminated when said external forces operating upon said coupling system cause said follower block to laterally travel within said center sill cavity.

2. The coupling system of claim 1 wherein each of said elastomeric wear pads are attached to a plate and each of said plates are centered on said respective follower block side walls.

3. In a railroad car center sill formed by connecting a top wall and a pair of side walls together to define an inverted generally U-shaped structure having a longitudinal axis with a corresponding cavity, an improved follower block comprising:

a generally rectangularly shaped solid body, said body including a top wall, a bottom wall, a first side wall, a second side wall, a front face and a rear face, said front face having a raised portion containing a spherically shaped recess for receiving a coupler butt end; and means attached and centered on each of said follower block sidewalls for preventing said follower block from directly contacting said center sill side walls and for protecting said follower block sidewalls from metal-to-metal contact, said means extending outwardly from said follower block sidewalls and across said center sill cavity in immediate approximation with said center sill side walls thereby eliminating abrasive metal-to-metal contact between said follower block and said center sill side walls and whereby wear of said center sill and follower block side walls is prevented when external forces operate upon said coupling system and cause said follower block to laterally travel within said center sill cavity.

4. The improved follower block of claim 3 wherein each of said wear pads are attached to a plate.

* * * * *